US005489761A

United States Patent [19]

Aslam et al.

[11] Patent Number: 5,489,761

[45] Date of Patent: Feb. 6, 1996

[54] METHOD OF CONTROLLING FUSER DURING STANDBY

[75] Inventors: Muhammad Aslam, Rochester; Robert D. Bobo, Ontario, both of N.Y.

[73] Assignee: Eastman Kodak Company, Rochester, N.Y.

[21] Appl. No.: 318,925

[22] Filed: Oct. 6, 1994

[51] Int. Cl.[6] ..... H05B 1/00; H05B 3/00; H05B 11/00

[52] U.S. Cl. ..... 219/216; 355/285; 355/290

[58] Field of Search ..... 355/282, 285, 355/289, 290; 219/216, 469

[56] References Cited

U.S. PATENT DOCUMENTS

| | | | |
|---|---|---|---|
| 4,081,213 | 3/1978 | Bar-on et al. | 355/282 X |
| 4,719,489 | 1/1988 | Ohkubo et al. | 355/290 |
| 5,111,249 | 5/1992 | Owada | 355/285 |
| 5,287,155 | 2/1994 | Arai et al. | 355/285 |

FOREIGN PATENT DOCUMENTS

| | | |
|---|---|---|
| 0138681 | 6/1991 | Japan . |
| 0188178 | 7/1992 | Japan . |
| 0241473 | 9/1993 | Japan . |

*Primary Examiner*—Robert Beatty
*Attorney, Agent, or Firm*—Leonard W. Treash, Jr.

[57] ABSTRACT

Heatset of a fusing roller in a fuser in which the rollers are not separated during standby is prevented by periodically rotating the rollers. To prevent a temperature surge caused by elimination of heat-absorbing sheets between the rollers during standby, the rollers are rotated at a reduced speed for a short time at the beginning of the standby period after a run. To also prevent temperature fluctuations due to the periodic rotation during standby, that rotation is controlled to a small amount to prevent the sensor from contacting an entirely new portion of the fusing roller surface with each periodic rotation.

4 Claims, 2 Drawing Sheets

METHOD OF CONTROLLING FUSER DURING STANDBY

BACKGROUND OF THE INVENTION

This invention relates to the fusing of toner images. More specifically, it relates to the control of a pressure roller fuser which has a "run" condition in which it is actually fusing toner images to a receiving sheet and a "standby" condition in which it is ready to fuse toner images. A modem copier or printer may be in standby condition 95% of a working day.

Some pressure roller fusers used commercially are not separated during their standby condition to save the cost of the separating structure and to improve reliability. Since the fuser is kept warm during standby, the rollers are usually continuously rotated in most such structures to prevent heatset of the more compliant of the rollers. Although heatset is prevented, continuously running the fuser during standby substantially reduces the life of pans, for example, the bearings and the rollers themselves.

SUMMARY OF THE INVENTION

It is an object of the invention to provide a method of controlling a fuser generally of the type described in which such wear is reduced without risking heatset.

This and other objects are accomplished by a method of controlling the operation of the roller fuser having both run and standby conditions, in both of which conditions the rollers are engaged. The method includes rotating the rollers at a first speed during the run condition. When switching from run to standby, the rollers can be rotated at a second speed less than the first speed for a limited period of time, but are then stopped and periodically rotated. The periodic rotation prevents heatset of the compliant roller without wearing the pans to the extent they are worn by continuous running.

We have found that even a substantial period of time, as long as ten minutes between small rotations of the rollers, will not cause a heatset. We have also found that a relatively small rotation will avoid the heatset.

When sheets are no longer being fed through the fuser, a heat surge occurs at the surfaces of the rollers, because no sheets are absorbing heat from the nip. Turning off the heat source has a delayed effect on the roller temperature. According to a preferred embodiment, rotating the rollers at a reduced speed at the beginning of standby after a run helps stabilize the standby temperature of the roller.

Further, commonly used heat sensors draw heat from the fusing roller at the position of contact. The periodic movement of the roller during standby causes the heat sensor to contact a fresh portion of the roller that appears hotter to it than the portion just contacted. This causes an immediate shutdown of the heat to the roller which may cause a reduction in temperature of the roller below the desired standby temperature. According to another preferred embodiment of the invention, we have solved this problem by intermittently rotating the rollers during standby by a large enough frequency and amount to eliminate heatset, but by such a small amount with each intermittent rotation that the temperature sensor is still partially affected by the portion of the fusing roller it had been contacting.

Using the preferred embodiments, the method reduces the wear of parts in a fusing roller of the type that does not disengage during standby without heatset of the compliant roller and without undue temperature fluctuations.

DETAILED DESCRIPTION OF INVENTION

Figure 1:
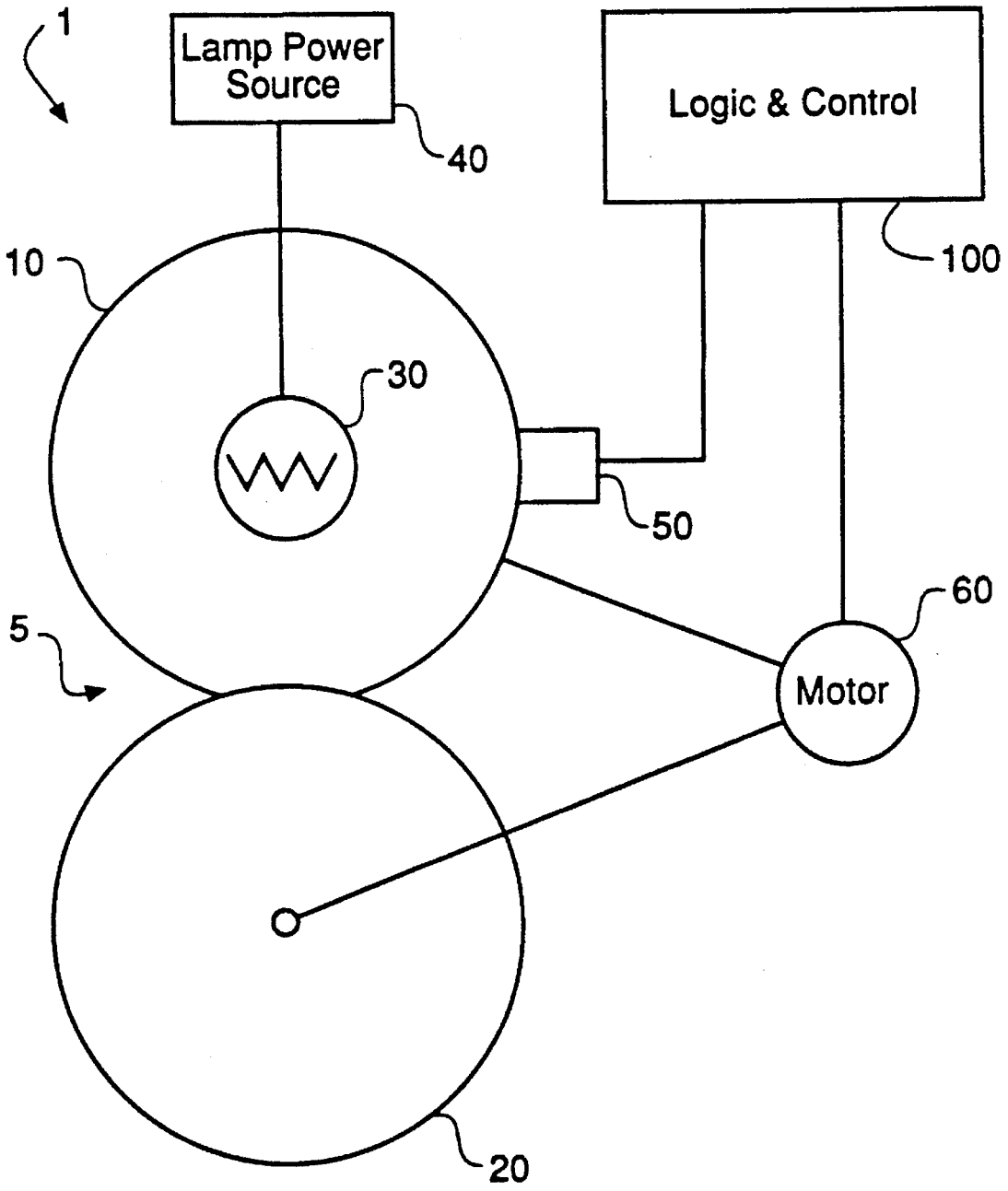
FIG. 1 is a front schematic of a fuser.

FIG. 1 shows a fuser 1 of known design in which the invention is usable. Fuser 1 includes a pair of rollers, including a fusing roller 10 and a pressure roller 20. Fusing roller 10 is internally heated by a lamp 30 which is powered by a variable lamp power source 40. Power source 40 is controlled by a logic and control 100 in response to a temperature sensor 50. Sensor 50 can be of a variety of structures, but conventionally is a thermistor bead enclosed in a heat conductive, for example, a carbon shoe. The shoe absorbs substantial heat from the surface of fusing roller 10 and transfers the heat to the thermistor bead. Rollers 10 and 20 are driven by a variable speed motor 60 which is also controlled by logic and control 100.

For both simplicity and reliability, the rollers are not separable. When the rollers are unheated, they contract sufficiently that a fusing nip 5 is reduced and a set from the rollers being in a single position is not a problem. However, if they are stopped while hot, for example during standby, for a substantial time, a heatset in the more compliant roller will reduce the quality of fusing and the life of the roller. For that mason, it is conventional to continue to rotate the rollers during standby (or to separate them).

We have found that if the rollers are stopped during standby but periodically rotated, for example, every two minutes, heatset is prevented and the life of the bearings and other similar parts is extended. Two problems were encountered in following this strategy.

Figure 2:
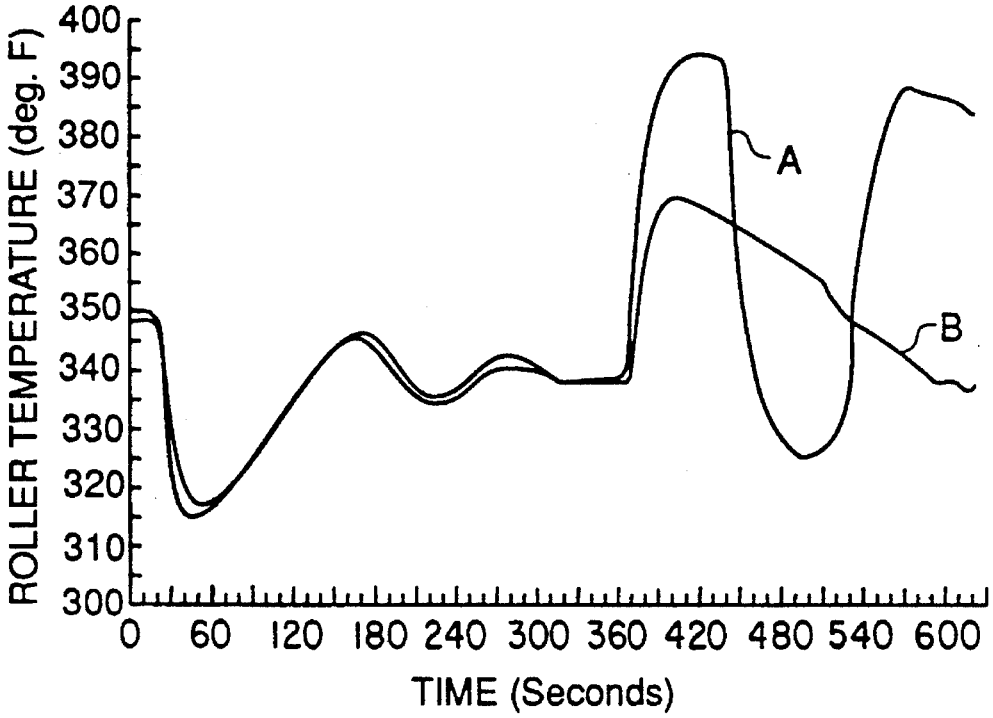
FIGS. 2 and 3 are graphs of roller temperature against time under various conditions.

First, when the rollers are stopped and no sheets are moved through the fuser, the fusing roller experiences a temperature surge before reducing power to lamp 30 takes effect. Curve A in FIG. 2 illustrates this phenomenon. A fusing roller that has been running at a temperature of 340° F. is stopped after running for 360 seconds. The lack of sheets in the nip causes a temperature surge to nearly 400° F. If a run signal is given during this increase, the fuser will be above its desired temperature for fusing. Further, the temperature of the fusing roller continues to fluctuate substantially as the higher temperature causes lamp 30 to shut off.

We have found that this problem can be greatly reduced by continuing to rotate the fuser at a substantially lower speed for a short period of time at the beginning of standby after a run. Continuing to turn the rollers after the run allows the pressure roller to heat sink some of the surge away from the fuser roller. For example, if the run speed is 15 inches per second, we reduce the speed to 2 inches per second for the first two minutes of standby. The result is shown on curve B in FIG. 2. The immediate slowing of the fusing roller causes a much lower surge of heat, to somewhat less than 370° F. and a much slower and less formidable vacillation back to a standby temperature between 350° and 355° F.

After the slow running for a short time, say two minutes, the motor 60 is stopped. To prevent heatset the rollers are turned periodically, for example, every two minutes. However, when the rollers are stopped, temperature sensor 50, because of its size and heat capacity, immediately absorbs heat from the portion of the fusing roller 10 in contact with it in the stopped position. This causes logic and control 100 to assume that the entire roller is cooler than it in fact is and it powers lamp power source 40 to apply power to lamp 30 to increase the temperature of fusing roller 10. This causes a surge in temperature of fusing roller 10. For example, if the set temperature for logic and control is 350° F., then that temperature will be maintained in the area contacting sensor 50. However, because of the absorption of heat by sensor 50, the rest of the fusing roller will be somewhat higher, in this example, approximately 50 higher at 355° F.

When fusing roller 10 is rotated to put a new portion of fusing roller 10 in nip 5, logic and control 100 reads an increase in temperature in fusing roller 10 from the new portion of fusing roller 10 contacting sensor 50. It thus shuts down the power to lamp 30 which reduces the temperature of the fusing roller until that reduction ultimately triggers logic and control 100 through sensor 50 to add heat again.

We have found that this problem can be controlled by rotating rollers 10 and 20 by an amount sufficient to avoid the heatset problem, but an amount insufficient to remove the old contact area of fusing roller 10 from at least some influence on sensor 50. For example, with a shoe that covers a half inch of the circumference of fusing roller 10, motor 60 is actuated long enough to rotate fusing roller 10 to move its circumference one-quarter inch every two minutes. This one-quarter inch every two minutes is adequate to avoid heatset with this particular fuser. At the same time, the influence of the old portion of the fusing roller contacting sensor 50 on the newly contacted portion prevents wide temperature swings.

Figure 3:
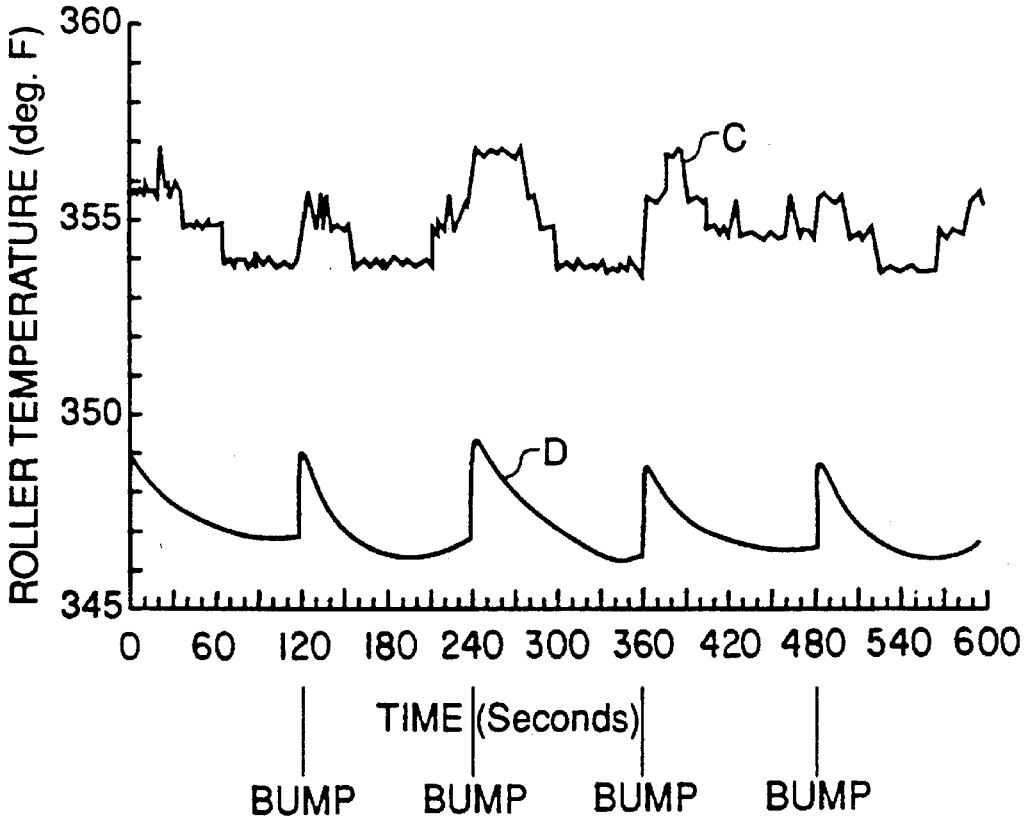

This is shown in FIG. 3. With motor 60 turned on for only one and one-half seconds every two minutes, the fusing roller moves one-quarter inch at its circumference. This movement causes less than a 4° F. temperature variation in the surface of the roller (curve C). Curve D is the variation in the set point temperature, i.e., the temperature of the portion of the fusing roller under sensor 50. Note that the set point temperature is about 50 less than the desired standby temperature to compensate for the amount of heat absorbed from the fusing roller surface by the sensor 50.

Actual experiments conducted on a conventional fuser with a hard pressure roller and a compliant fusing roller showed that heatset is prevented if the rollers were systematically prevented from being at the same relative position while hot for more than ten minutes. Thus, a slight movement every two minutes need not completely provide a new surface of fusing roller 10 to nip 5. Thus, prevention of heatset may be prevented even if the movement is so slight that several of them are needed within the ten minute period to fully exchange the portion of the fusing roller in the nip.

The invention has been described in detail with particular reference to a certain preferred embodiment thereof, but it will be understood that variations and modifications can be effected within the spirit and scope of the invention.

We claim:

1. A method of controlling the operation of a roller fuser, which roller fuser is of the type having a pair of rotatable rollers engaged to form a pressure nip, at least one of the rollers being a heated fusing roller, a temperature sensor contacting a peripheral surface of the fusing roller, which temperature sensor absorbs heat from a localized contact portion of the fusing roller, the fuser having a run condition in which it fuses images fed into the nip and a standby condition in which it is ready to fuse images but is not fusing them, the rollers being engaged in both conditions, and the fuser including means for switching between the run and standby conditions, said method comprising:

rotating the rollers at a first speed during the run condition; and stopping the rollers during the standby condition and periodically rotating the rollers an amount sufficient to prevent heatset of one of the rollers but an amount insufficient with each periodic rotation to move the portion of the roller contacted by the heat sensor prior to the rotation out of temperature influence of the sensor.

2. The method according to claim 1 wherein the temperature sensor contacts the fusing roller over a predetermined circumferential distance of the fusing roller and wherein the amount of movement in the periodically rotating sub-step of the circumference of the fusing roller is less than that contact amount.

3. The method according to claim 1 further including, when switching from run to standby conditions, first rotating the rollers at a second speed slower than the first for a limited period of time.

4. A method of controlling the operation of a roller fuser, which roller fuser is of the type having a pair of rotatable rollers engaged to form a pressure nip, at least one of the rollers being a heated fusing roller, a temperature sensor contacting a peripheral surface of the fusing roller, which temperature sensor absorbs heat from a localized contact portion of the fusing roller, the fuser having a run condition in which it fuses images fed into the nip and a standby condition in which it is ready to fuse images but is not fusing them, the rollers being engaged in both conditions, and the fuser including means for switching between the run and standby conditions, said method comprising:

rotating the rollers at a first speed during the run condition;

stopping the rollers during the standby condition and periodically rotating the rollers an amount sufficient to prevent heatset of one of the rollers; and when switching from run to standby condition, first rotating the rollers at a second speed slower than the first speed for a limited period of time before stopping the rollers.

* * * * *